US007950905B2

(12) United States Patent
Djordjevic

(10) Patent No.: US 7,950,905 B2
(45) **Date of Patent: *May 31, 2011**

(54) RADIAL PISTON FUEL SUPPLY PUMP

(75) Inventor: Ilija Djordjevic, East Granby, CT (US)

(73) Assignee: Stanadyne Corporation, Windsor, CT (US)

( * ) Notice: Subject to any disclaimer, the term of this patent is extended or adjusted under 35 U.S.C. 154(b) by 94 days.

This patent is subject to a terminal disclaimer.

(21) Appl. No.: 12/381,877

(22) Filed: Mar. 17, 2009

(65) Prior Publication Data

US 2009/0208355 A1 Aug. 20, 2009

Related U.S. Application Data

(63) Continuation of application No. 11/255,395, filed on Oct. 21, 2005, now Pat. No. 7,524,171, which is a continuation-in-part of application No. 10/857,313, filed on May 28, 2004, now Pat. No. 7,134,846.

(51) Int. Cl.
*F04B 1/04* (2006.01)

(52) U.S. Cl. ..... 417/273; 417/521; 417/440; 417/307

(58) Field of Classification Search ..... 417/273, 417/521, 440, 307, 470; 92/72, 132, 130 C, 92/130 R, 130 B, 73, 140; 91/491; 74/49, 74/55

See application file for complete search history.

(56) References Cited

U.S. PATENT DOCUMENTS

| | | | |
|---|---|---|---|
| 3,908,517 | A | 9/1975 | Wenbourne |
| 4,386,587 | A | 6/1983 | Simko |
| 4,548,124 | A | 10/1985 | Ortelli |
| 4,576,128 | A | 3/1986 | Kenichi |
| 4,803,889 | A | 2/1989 | Harris |
| 5,067,881 | A | 11/1991 | Maehara |
| 5,145,339 | A | 9/1992 | Lehrke et al. |
| 5,690,065 | A | 11/1997 | Janse van Vuuren |

(Continued)

FOREIGN PATENT DOCUMENTS

DE 102004026584 A1 12/2005

(Continued)

OTHER PUBLICATIONS

Search Report under Section 17, dated Aug. 3, 2005, Great Britain.

(Continued)

*Primary Examiner* — Michael Cuff
*Assistant Examiner* — Vikansha S Dwivedi
(74) *Attorney, Agent, or Firm* — Alix, Yale & Ristas, LLP

(57) ABSTRACT

A high pressure radial piston fuel pump is featured having an hydraulic head with two individual radial pumping pistons and associated pumping chambers, annularly spaced around a cavity in the head where a rotating eccentric drive member with associated actuation ring are situated. A rolling interaction is provided between the actuation ring and the inner ends of the pistons for intermittent actuation. Relative rotation is provided between the actuation ring and the drive member. Each piston has a piston bore that has a centerline that intersects the actuation ring but is offset (X) from the drive axis as viewed in cross section perpendicularly to the drive axis and the piston bore centerlines are parallel to each other but offset (Y) from each other as viewed in longitudinal section along the drive axis.

9 Claims, 14 Drawing Sheets

U.S. PATENT DOCUMENTS

| | | | | |
|---|---|---|---|---|
| 5,826,551 | A | 10/1998 | Janse van Vuuren | |
| 5,842,405 | A * | 12/1998 | Schaefer et al. | 92/84 |
| 5,897,302 | A | 4/1999 | Siegel et al. | |
| 6,109,894 | A | 8/2000 | Chatelain | |
| 6,205,980 | B1 | 3/2001 | Spinnler | 123/495 |
| 6,231,468 | B1 | 5/2001 | Bajulaz | |
| 6,257,190 | B1 | 7/2001 | Linebarger | |
| 6,446,604 | B1 * | 9/2002 | Guentert et al. | 123/456 |
| 6,457,957 | B1 * | 10/2002 | Bauer et al. | 417/562 |
| 6,991,438 | B2 | 1/2006 | Blessing et al. | |
| 7,108,491 | B2 | 9/2006 | Ganser | 417/470 |
| 2001/0015200 | A1 | 8/2001 | Mori | |
| 2003/0180159 | A1 | 9/2003 | Blessing et al. | |

FOREIGN PATENT DOCUMENTS

| | | | |
|---|---|---|---|
| EP | 0 628 721 | A1 | 12/1994 |
| EP | 0 809 023 | A2 | 11/1997 |
| EP | 0 881 380 | A1 | 12/1998 |
| GB | 1 437 943 | | 5/1973 |
| SU | 979689 | A1 | 12/1982 |
| WO | WO 91/02157 | A1 | 2/1991 |

OTHER PUBLICATIONS

Examination Report under Section 18(3), dated Jul. 10, 2008, Great Britain.

Search Report under Section 17, dated Mar. 4, 2009, Great Britain.

Examination Report under Section 18(3), dated Mar. 25, 2009, Great Britain.

* cited by examiner

RADIAL PISTON FUEL SUPPLY PUMP

RELATED APPLICATION

This application is a continuation of, and claims the benefit of, U.S. application Ser. No. 11/255,395 filed Oct. 21, 2005 for "Radial Piston Fuel Supply Pump", which in turn is a continuation-in-part of, and claims the benefit of, U.S. application Ser. No. 10/857,313 filed May 28, 2004 for "Radial Piston Pump with Eccentrically Driven Rolling Action Ring", now U.S. Pat. No. 7,134,846, issued Nov. 14, 2006.

BACKGROUND OF THE INVENTION

The present invention relates to diesel fuel pumps, and more particularly, to radial piston pumps for supplying high-pressure diesel fuel to common rail fuel injection systems.

Diesel common rail systems have now become the state of the art in the diesel engine industry and furthermore, they are currently entering into their second and sometimes even third generation. Attention is presently focused on realizing further improvements in fuel economy and complying with more restrictive emission laws. In pursuit of these goals, engine manufacturers are more willing to select the most effective component for each part of the overall fuel injection system, from a variety of suppliers, rather than continuing to rely on only a single system integrator.

As a consequence, the present inventors have been motivated to improve upon the basic concepts of a two or three radial piston high-pressure fuel supply pump, to arrive at a highly effective and universally adaptable pump that can be incorporated into a wide variety of common rail injection systems.

SUMMARY OF INVENTION

According to the invention, an hydraulic head features two, three, or four individual radial pumping pistons and associated pumping chambers, annularly spaced around a cavity in the head where one or more eccentric drive members with associated outer rolling actuation ring are situated, whereby a rolling interaction is provided between the actuating ring and the inner ends of the pistons for intermittent actuation, and a sliding interaction is provided between the actuation ring and the drive member.

The actuation force for each pumping event is sequentially transferred from the eccentric to the pistons by the rolling actuation ring, which is supported on the drive member by either a force-lubricated bushing or by a needle bearing, located approximately in the middle of the shaft. The outside diameter of this rolling element preferably is barrel shaped (crowned), to compensate for any misalignment of the pistons relative to the drive shaft due, for example, to either tolerance stack up or deflection.

Preferably, a semi rigid yoke that connects opposed pistons is in the form of a "C" band, with beveled holes at both ends for capturing a smoothly flared foot on the piston. This forces the inactive (not pumping) piston toward bottom dead center, while the other piston is pumping, by means of a so-called desmodromic dynamic connection. The rigidity of the yoke must be adequate to minimize deflection (even at maximum vacuum at zero output conditions), as any separation and subsequent impact at the start of pumping would have a detrimental effect on life expectancy. At the same time the contact force between the pistons and the outer diameter of the rolling element should be kept as low as possible, to minimize wear and heat generation during the intermittent sliding, which occurs only during the charging cycle, and to facilitate oil film replenishment. The combination of beveled capture hole and contoured foot, greatly reduces stress and wear at the interface.

In one embodiment, the pump has only two piston bores and associated two pistons, each piston bore has a centerline that intersects the actuation ring but is offset from the drive axis, and the piston bore centerlines are parallel to each other but offset from each other as viewed along the drive axis.

In another embodiment, the pump has three substantially equiangularly spaced apart piston bores and associated three pistons and each piston bore has a centerline that intersects the actuation ring but is offset from the drive axis as viewed along the drive axis.

In yet another embodiment, a pair of cylindrical drive members or rollers are rigidly carried axially side-by-side and offset from the drive shaft for rotation and interaction with a respective pair of opposed pistons. Thus, four pistons are configured at approximately 90 degree separation increments.

Preferably, each piston is situated in its respective piston bore not only for free reciprocating movement along the bore axis during charging and discharging phases of operation, but also for free rotation about the piston axis to accommodate any unbalanced forces acting at the interface between the radially inner end of the piston (or its associated shoe) and the actuating ring.

Pump output is preferably controlled by inlet metering with a proportional solenoid valve, but other commonly available control techniques can be used provided, however, that the opening pressure of the inlet check valves should be high enough to prevent uncontrolled and undesired charging by vacuum created by the pistons during the suction stroke. In order to improve control resolution and by that to insure full controllability at even the lowest speeds the control solenoid valve should be either of flow proportional type or pressure proportional type combined with a variable flow area orifice.

The present invention is particularly adapted to improve upon the radial piston pump with eccentrically driven rolling actuation ring as described in U.S. patent application Ser. No. 10/857,313, the disclosure of which is hereby incorporated by reference. The advantages set forth in that application are also realized in the invention claimed herein. However, several additional advantages are realized with the present invention. One advantage or improvement is in the flared shape of the piston shoe or foot, which avoids sharp angles at the transition between the stem and the foot, and preferably blends with the smooth contour, thereby avoiding the intense concentration of stress at the interface as arise with conventional shaped piston members. When combined with the optimal offset of both pistons relative to the shaft axis as viewed along the shaft axis, the torque loading on the foot at either extreme of the contact of the actuating member, can be balanced.

Another improvement is in the capture of the opposed piston feet through beveled holes at ends of the C-band spring such that the bevel substantially conforms to the contour of the foot and thereby reduces stresses and wear.

Yet another improvement is that the C-band spring is retained within a guide channel of the cavity wall thereby permitting apparent reciprocating displacement of the spring in parallel with the reciprocation of the pistons, while avoiding axial movement or tilting within the cavity. The use of relatively rigid C-band springs, retained in the guide in the cavity, and the substantially mating surfaces between the apertures at the end of the C-band and the outer contour of the piston foot, all individually and especially collectively, contribute to achieving higher speed capability.

For even higher capacity, the pump can be provided with two sets of opposed pumping chambers, and associated opposed pistons, with each set actuated by one of a pair of side by side eccentric actuating members. With a total of four pistons, each actuated in approximately 90 degrees sequentially during one rotation of the drive shaft, a very robust, reliable, and compact high pressure fuel supply pump can be provided.

DESCRIPTION OF THE PREFERRED EMBODIMENT

Figure 1:
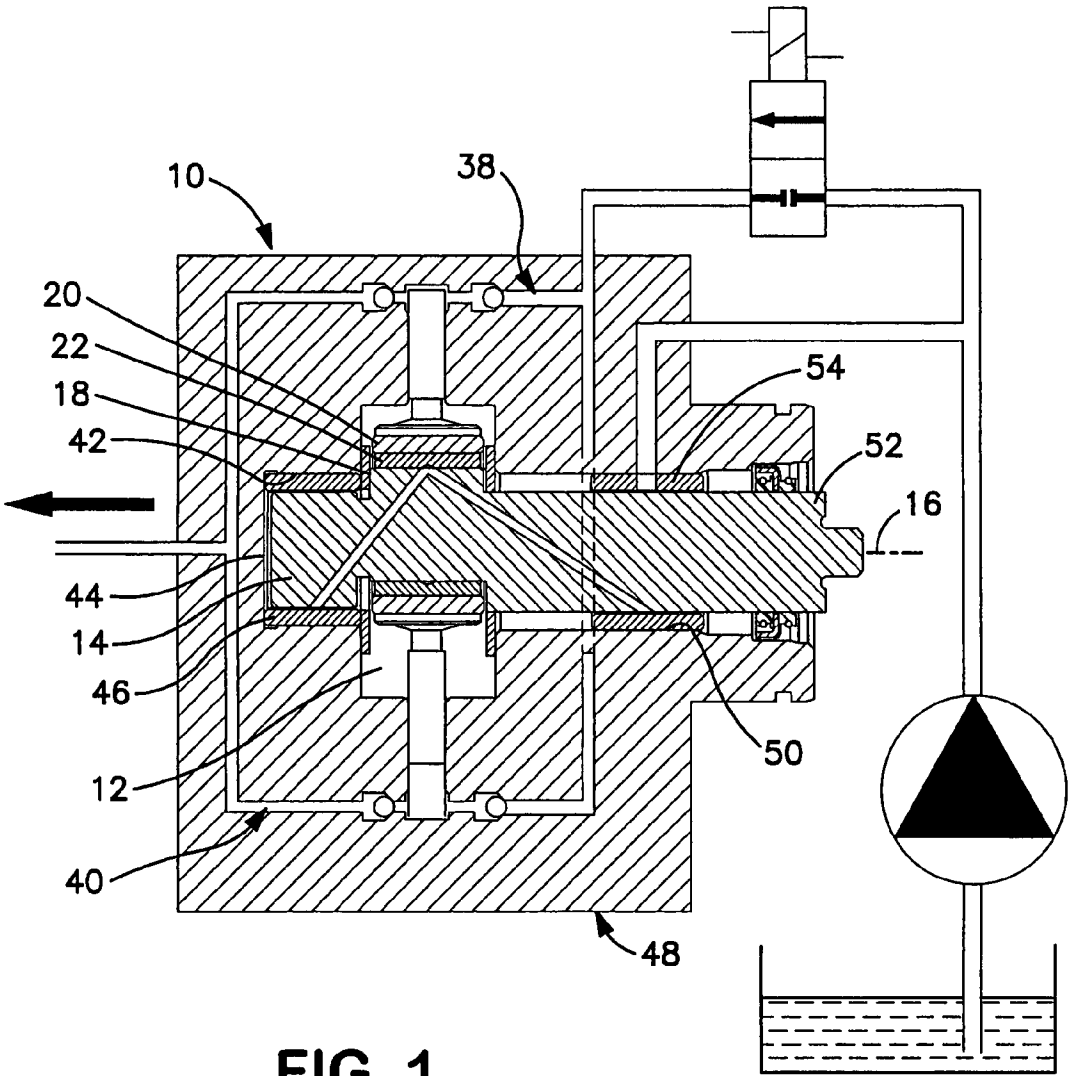
FIG. 1 is a schematic longitudinal section view of a two-piston pump according to a basic aspect of the present invention.
Figure 2:
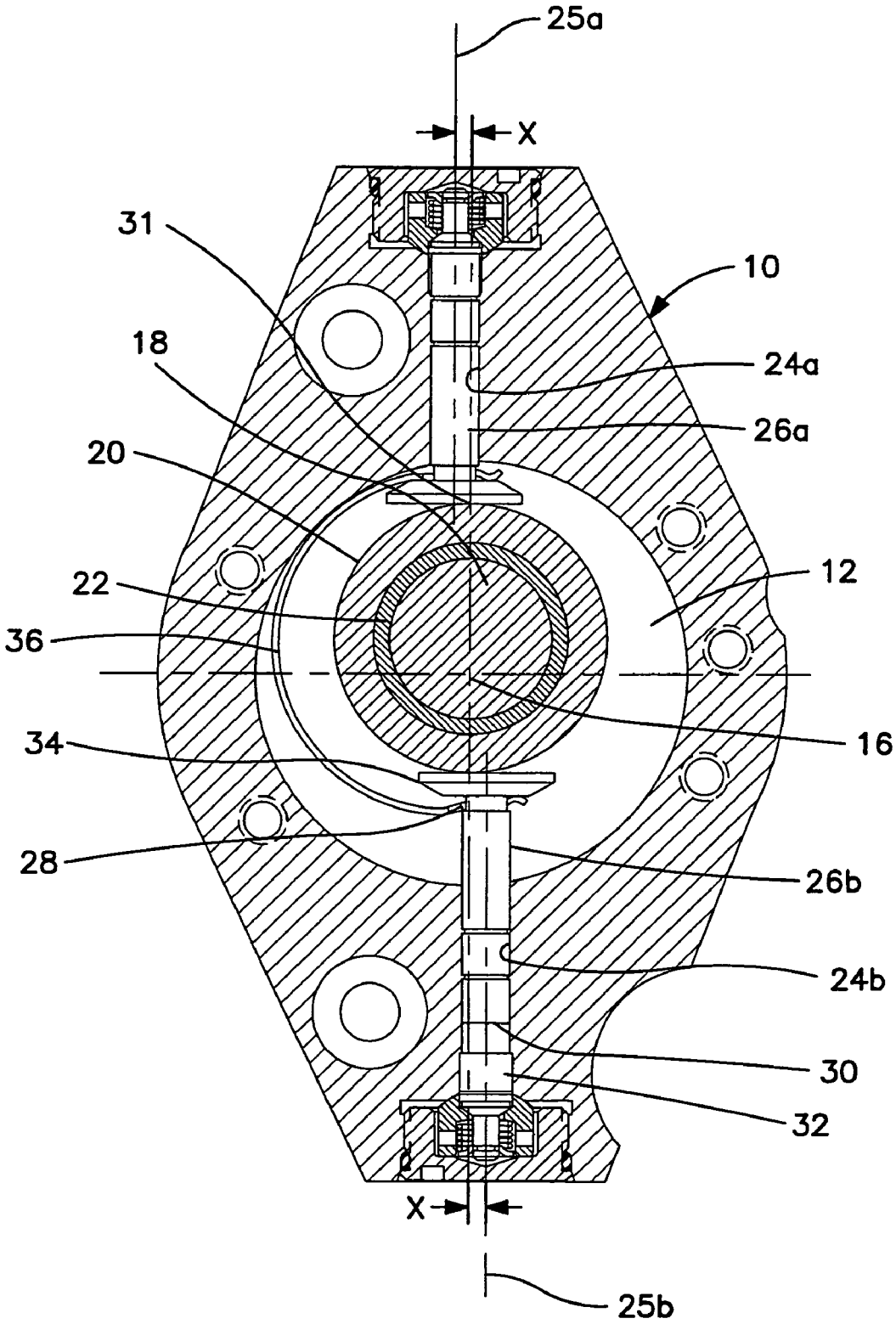
FIG. 2 is a schematic cross section view taken through the cavity of the hydraulic head shown in FIG. 1.

FIGS. 1 and 2 show a high pressure radial piston fuel pump comprising an hydraulic head 10 defining a central cavity 12 for receiving a rotatable drive shaft 14 longitudinally disposed along a drive axis 16 passing through the cavity. A cylindrical drive member 18 is rigidly carried by and offset from the drive shaft for eccentric rotation in the cavity about the drive axis as the drive shaft rotates. A substantially cylindrical piston actuation ring 20 is annularly mounted around the drive member. Bearing means 22, such as a needle bearing, is interposed between the drive member and the actuation ring, whereby the actuating ring is supported for free rotation about the drive member.

Two piston bores 24*a*, 24*b* extend in the head to the cavity 12, each piston bore having a centerline 25*a*, 25*b* that intersects the actuation ring but is offset (x) from the drive axis 16 as viewed along the drive axis (i.e., in section perpendicular to the drive axis). A piston 26*a*, 26*b* is situated respectively in each piston bore for free reciprocation and rotation therein. The pistons have an actuated end 28 in the cavity and a pumping end 30 remote from the cavity, wherein the pumping end cooperates with the piston bore to define a pumping chamber 32. A piston shoe or foot 34 rigidly extends from the actuated end of each piston, and has an actuation surface for maintaining contact with the actuation ring 20 during rotation of the drive shaft.

Means are provided for biasing each piston toward the cavity. This is preferably a semi-rigid yoke 36 arranged between the shoes to dynamically coordinate (and thus assure) the retraction of one piston with the actuation of the other piston, according to a desmodromic effect. This also avoids backlash impact at low loads. The desmodromic yoke is not absolutely necessary for practicing the broad aspects of the invention, in that dedicated return springs could be used for each piston (at extra cost and mass) or such biasing means could in some instances be eliminated.

A feed fuel valve train 38 is provided in the head for each pumping chamber, for delivering charging fuel through an inlet passage in the head at a feed pressure to the pumping chamber. Similarly, a high pressure valve train 40 is provided in the head for each pumping chamber, for delivering pumped fuel to a discharge passage in the head at a high pressure from the pumping chamber. Thus, during one complete rotation of the drive shaft, each pumping chamber undergoes two phases of operation. In a charging or inlet phase, the associated piston is retracted toward the cavity by the yoke, thereby increasing the volume of the pumping chamber to accommodate an inlet quantity of fuel from the inlet valve train. In the discharging or pumping phase, the associated piston is actuated away from the cavity by the actuation ring, thereby decreasing the volume of the pumping chamber and pressurizing the quantity of fuel for discharge through the discharge valve train.

The hydraulic head has a shaft mounting bore 42 coaxial with the drive shaft axis, for receiving one end 44 of the drive shaft, and bearing means 46 for rotationally supporting this end of the drive shaft. A removable mounting plate 48 is attached to the hydraulic head, and has a shaft mounting throughbore 50 for receiving the other end 52 of the drive shaft while exposing this other end for engagement with a source of rotational power. A suitable bearing 54 is provided in the mounting plate for rotationally supporting the driven end of the drive shaft. The mounting plate can also have passages connected to the low pressure feed pump, for supplying a lubricating flow of fuel to the shaft bearings and to the bearing between the eccentric drive member and the actuating ring.

A significant feature of the rolling relationship between the pistons and actuation ring, is that, although the actuating ring will always rotate (roll) around the drive member in the opposite direction to the rotation of the drive shaft, such rotation will be random, thereby avoiding concentrated wear at one location, and also assuring that lubricating fuel will quickly be replenished at any location where metal-to-metal contact has occurred. Furthermore, the offsets of the piston bores from the drive shaft axis, minimizes piston side loading.

Figure 3:
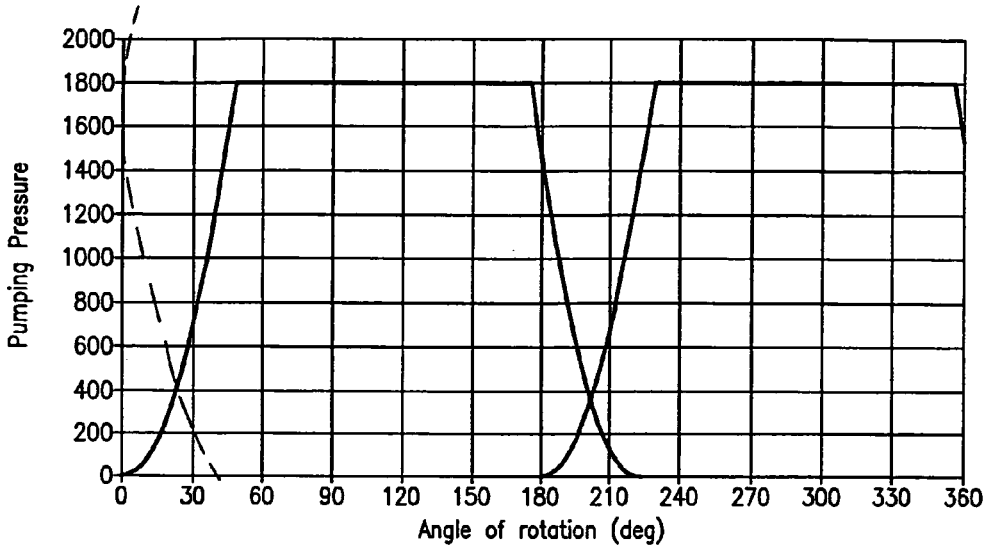
FIG. 3 is a graphic representation of the pumping pressure vs. angle of drive shaft rotation associated with the two piston pump of FIG. 1.

FIG. 3 is a graphic representation of the pumping pressure vs. angle of drive shaft rotation associated with the two piston pump of FIG. 1, running at a common rail pressure of 1800 bar and a pump speed of 1000 rpm, for a hypothetical case. The actuated ends of the pistons have a rolling interaction with the actuating ring unless both pistons are loaded simultaneously as can occur briefly during cold, whereupon a sliding interaction will be present. FIG. 3 shows that over a small included angle of drive shaft rotation (about 30-40 degrees) an overlapping pumping condition can exist, but the maximum pumping pressure during this overlap is less than 400 bar, which condition does not give rise to worrisome sliding friction.

Figure 4:
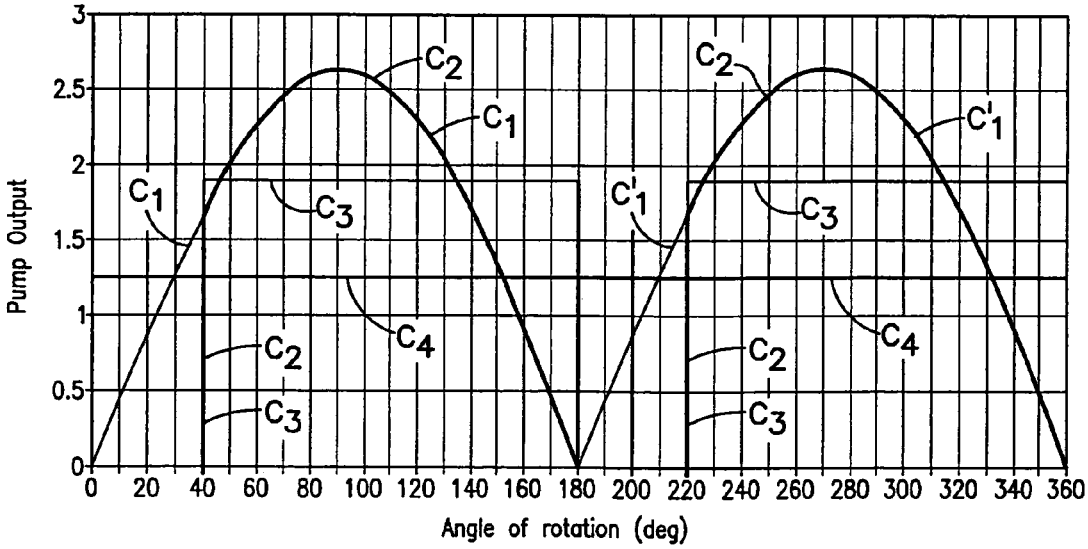
FIG. 4 is a graphic representation of the pump output vs. angle of drive-shaft rotation for the pump of FIG. 1.

FIG. 4 is a graphic representation of the pump output (rate) vs. angle of drive-shaft rotation for the pump of FIG. 1, at rated power and 1800 bar rail pressure, with inlet metering. The piston displacement is indicated by C1, the regulated delivery is indicated by C2, and the average pumping rate is indicated by C3. This shows that the high pressure in each pumping chamber during successive pumping events is well separated during rated power conditions.

Figure 5:
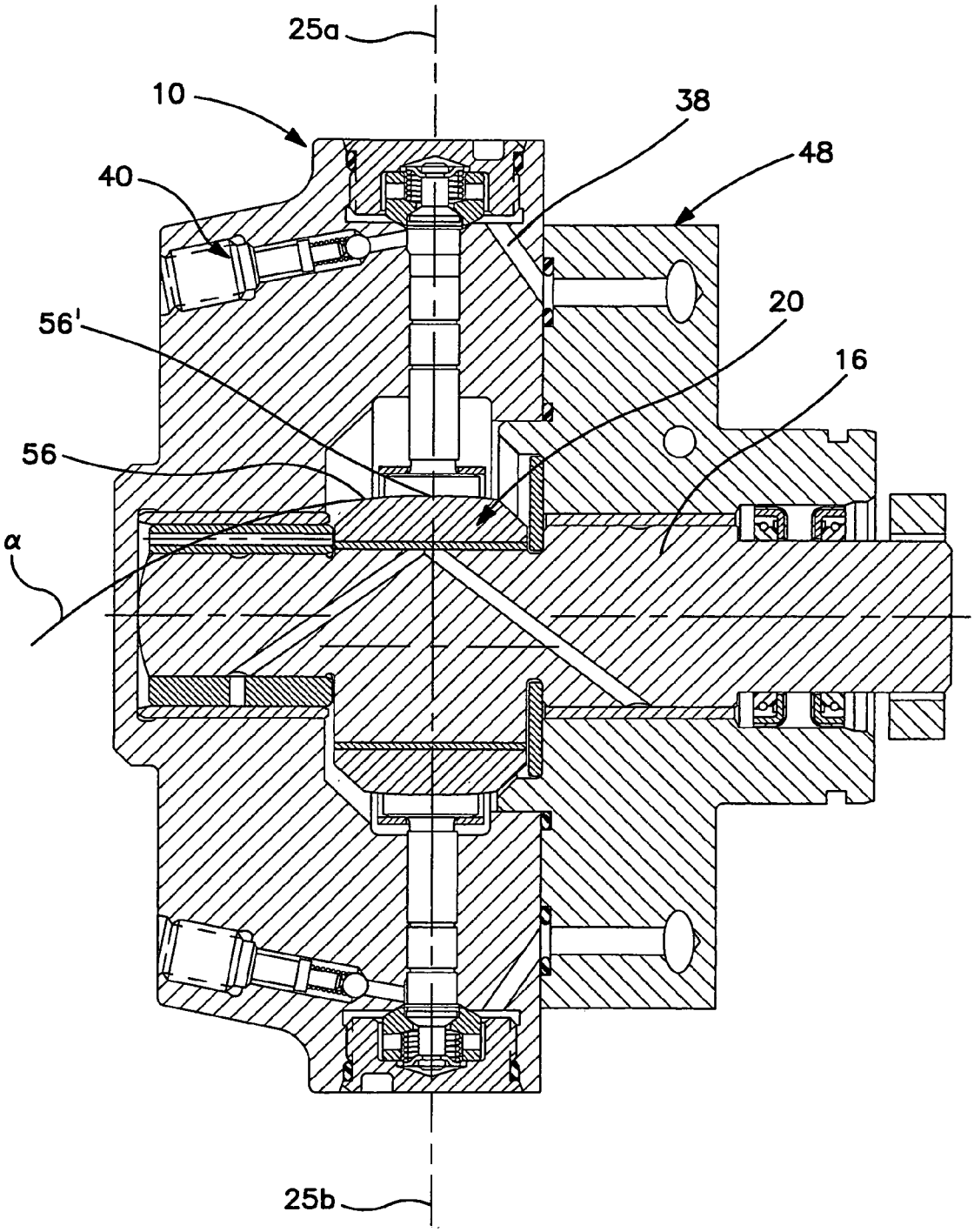
FIG. 5 is a longitudinal section view of the head of FIG. 1, with the additional features of a barrel shaped actuation ring with the center of the crown in the same plane as the centerlines of the piston bores, as viewed perpendicularly to the drive shaft axis.

FIG. 5 shows a variation in which the actuating ring 20 has an outer surface 56 that is somewhat barrel shaped. The curvature a rises and falls in the direction of the drive shaft axis and the center 56' of the crown radius always remains in a plane defined by the imaginary axes 25*a*, 25*b* of both pumping chambers.

This radius or curvature is quite large, e.g., on the order of about 3 feet. Even with random or systematic variations in the nominal parallelism between the centerline of the drive shaft and the rotation axis of the actuating ring and in the nominal relationship between the piston centerlines and the rotation axis of the actuating ring arising during operation, the crowning results in minimum piston side loading as the pumping force input point moves only insignificantly, following the eccentric during the pumping event. However this force input always rides in the same section of the piston head. Thus, the piston centerline is maintained in coaxial relation with the piston bore.

Figure 6:
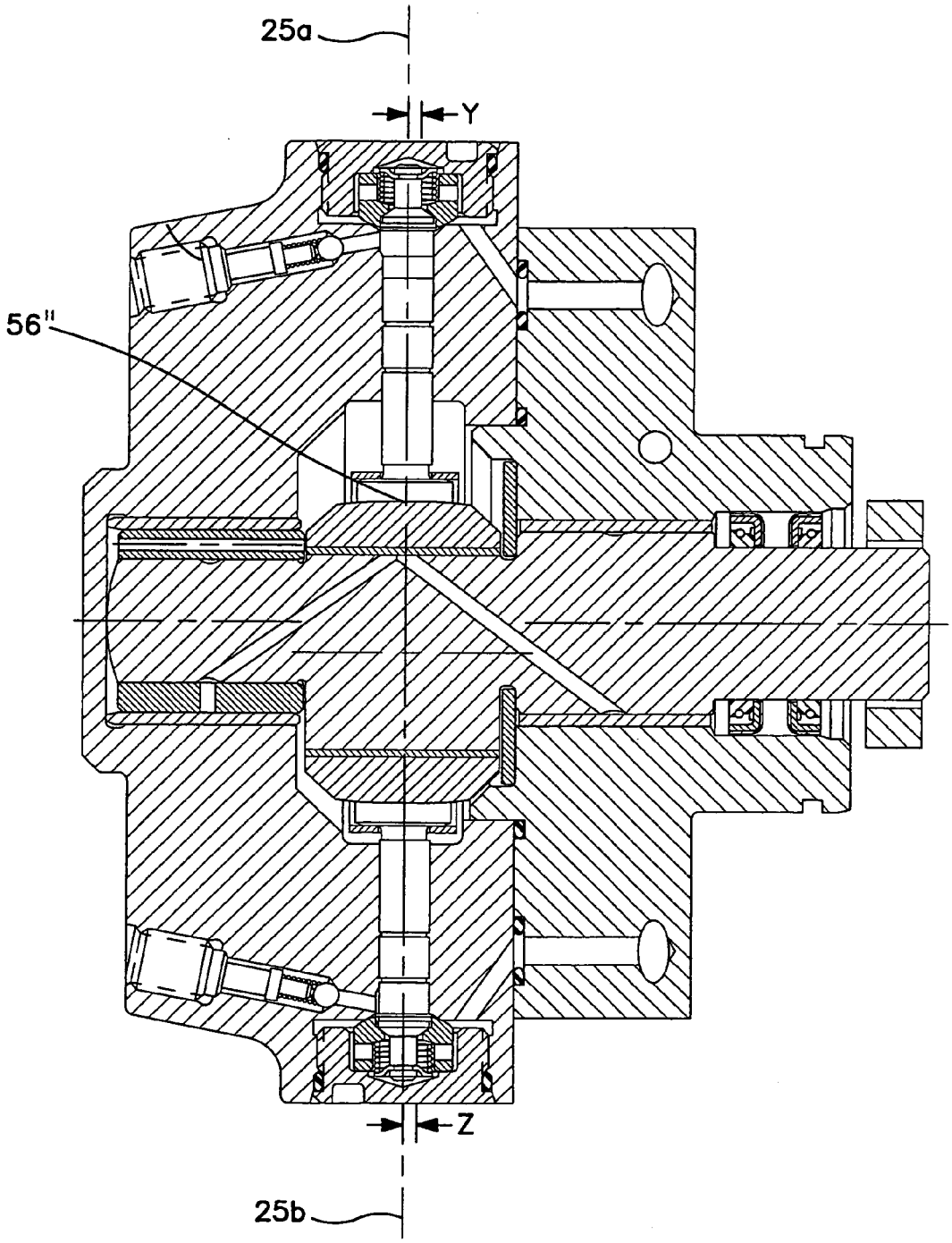
FIG. 6 is a view similar to FIG. 5, but with the centerlines of the piston bores offset from the center of the crown, as viewed perpendicularly to the drive shaft axis.

FIG. 6 shows two alternative configurations. First, the piston bore centerline (shown coplanar) could instead be parallel to each other but offset from each other as generally indicated at (y). Second, whether or not offset (y) is present, the high point or center 56" of the curvature radius of the crown can (as shown) lie in a plane parallel to but offset (z) from the centerlines 25*a*, 25*b* of both pumping piston bores, as viewed perpendicularly to the drive axis. The contact between the high point of the roller ring and the piston foot would be at the extension of the right dimension mark for (z) in FIG. 6. This embodiment increases piston side loading by a very small amount, but it will force the piston to rotate instead of slide during overlapping pumping events, reducing by that the cumulative number of load cycles at any given point on the shoes and the actuating ring.

Figure 8:
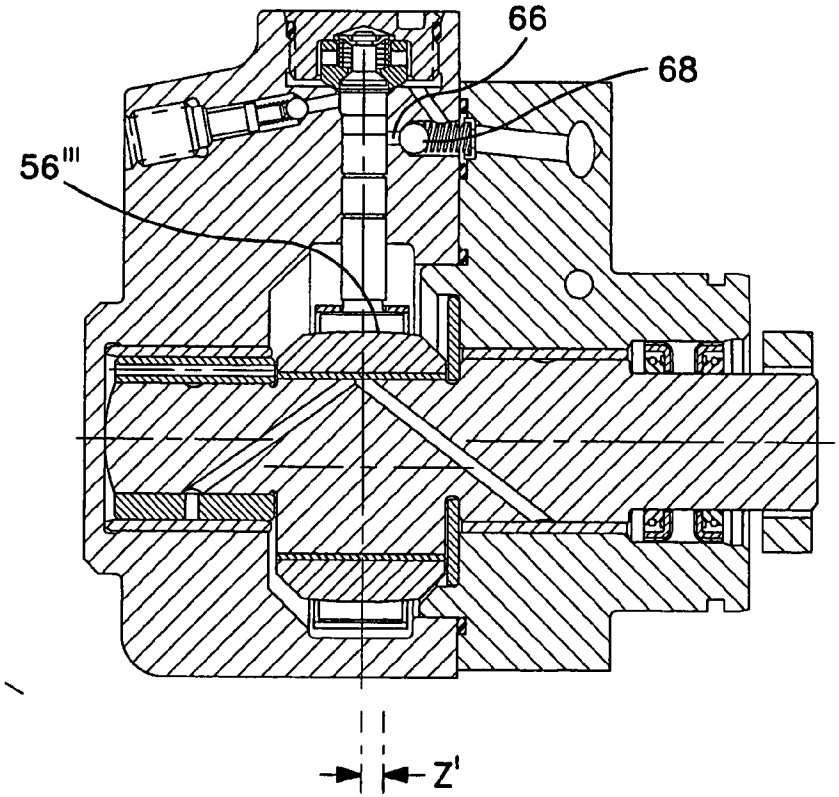
FIG. 8 is a section view through the hydraulic head of FIG. 7, including a pre-spill port with check valve for each pumping chamber.
Figure 7:
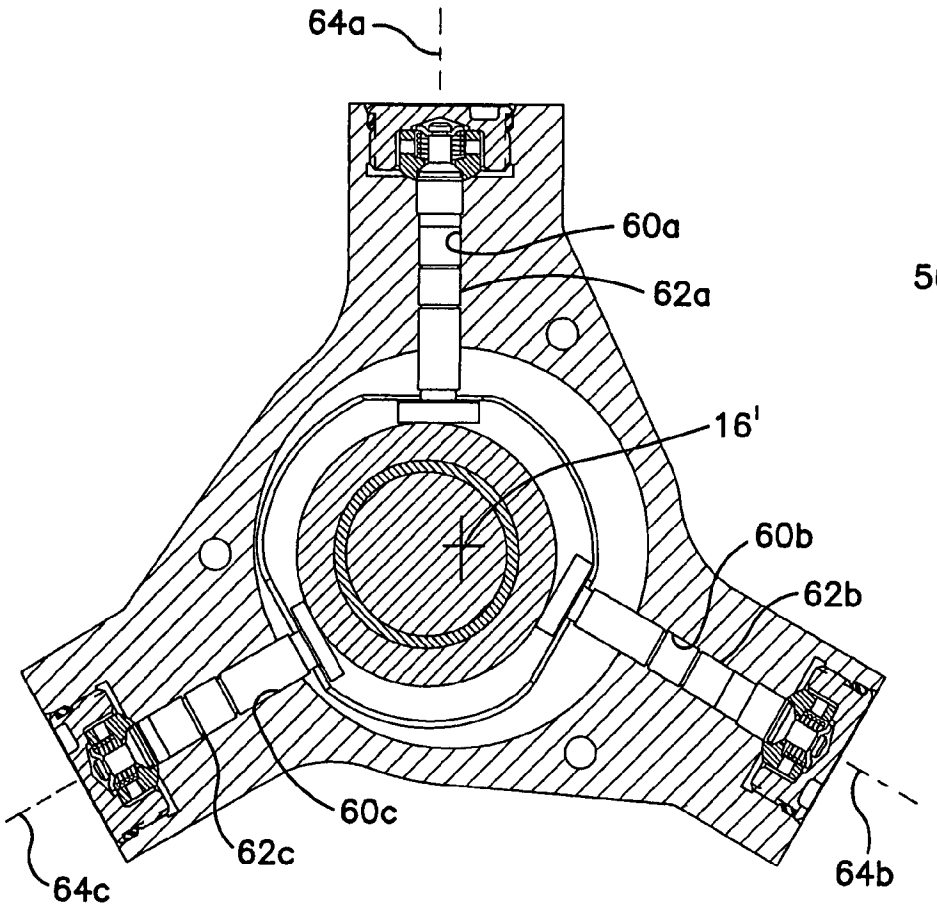
FIG. 7 is a cross sectional view through the cavity of a hydraulic head for a three piston pumping configuration according to the invention.

FIGS. 7 and 8 show the invention as embodied in a three-piston pump, with drive shaft axis indicated at 16', the piston bores indicated by 60*a*, 60*b*, and 60*c* and the pistons indicted by 62*a*, 62*b*, and 62*c*. In order to avoid simultaneous pumping of two chambers, which would lead to high force sliding at the roller/piston head interface, a fixed pre-spill port (66), delays the earliest start of pumping, resulting in separated pumping events. In essence, the discharge phase of the pumping chambers occur sequentially as distinct pumping events and each pumping chamber is fluidly connected to a pre-spill port for delaying the discharge of high pressure fuel through the discharge passage associated with a given pumping chamber, until the discharge of high pressure fuel through the discharge passage associated with the pumping chamber of the preceding pumping event has been completed. Because of the shortened pumping duration for each of three, rather than only two pumping events, the output increase is only about 20% over the two piston pump with the same eccentricity and piston diameter, but the three lower rate pumping events per revolution, reduce rail pressure pulsing and also offer more flexibility in injection event—pumping event synchronization.

By optionally adding a check valve 68 to the pre-spill passage, inlet metering output control can be performed through the same port. The check valve in the pre-spill channel insures pumping event separation and at the same time it prevents back filling by vacuum generated by the retracting piston. Piston rotation induced by the off-center contact point is beneficial with or without pre-spilling, because it constantly changes not only the contact point between the piston and roller, but also between the piston and its bore, thereby reducing the tendency for scuffing.

The three piston pump can also incorporate the configuration wherein the center 56'" of the curvature radius of the crown lies in a plane parallel to but offset z' from the centerlines 64*a*, 64*b*, 64*c* of the pumping piston bores, as viewed perpendicularly to the drive axis. During the time when more than one piston is pumping (100% of maximum possible output), instead of sliding, one or both piston are allowed to rotate, protecting by that the piston roller interface from premature damage.

FIGS. 9-16 are directed to preferred implementations, shown in a four piston pump, but to a large extent usable in the two or three piston pump embodiments described above.

Figure 9:
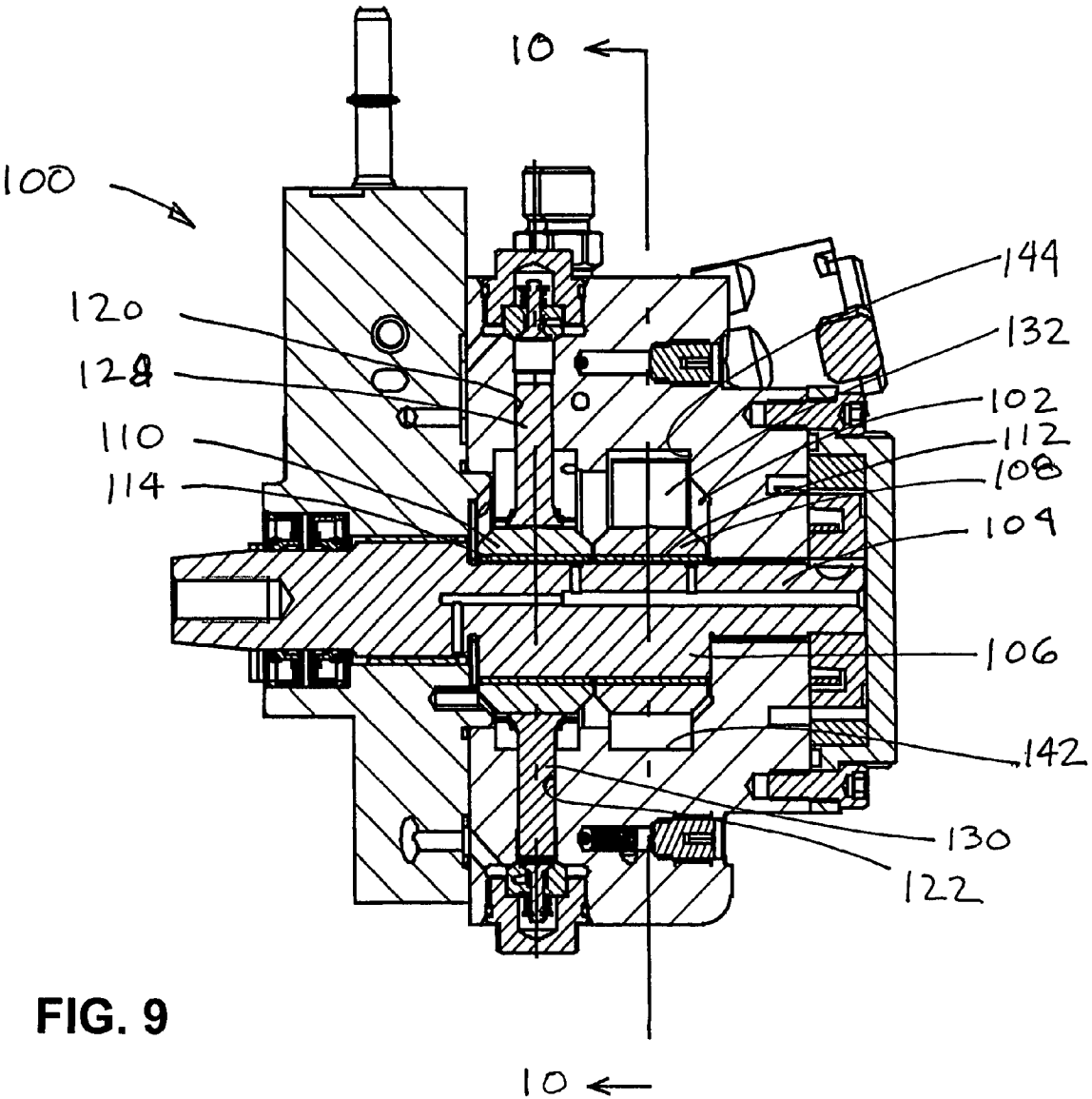
FIG. 9 is a section view through a pump incorporating further aspects of the invention, in a configuration where a pair of actuating rollers or rings are carried axially side by side and offset from drive shaft for eccentric rotation in conjunction with two side by side pair of opposed pistons.
Figure 10:
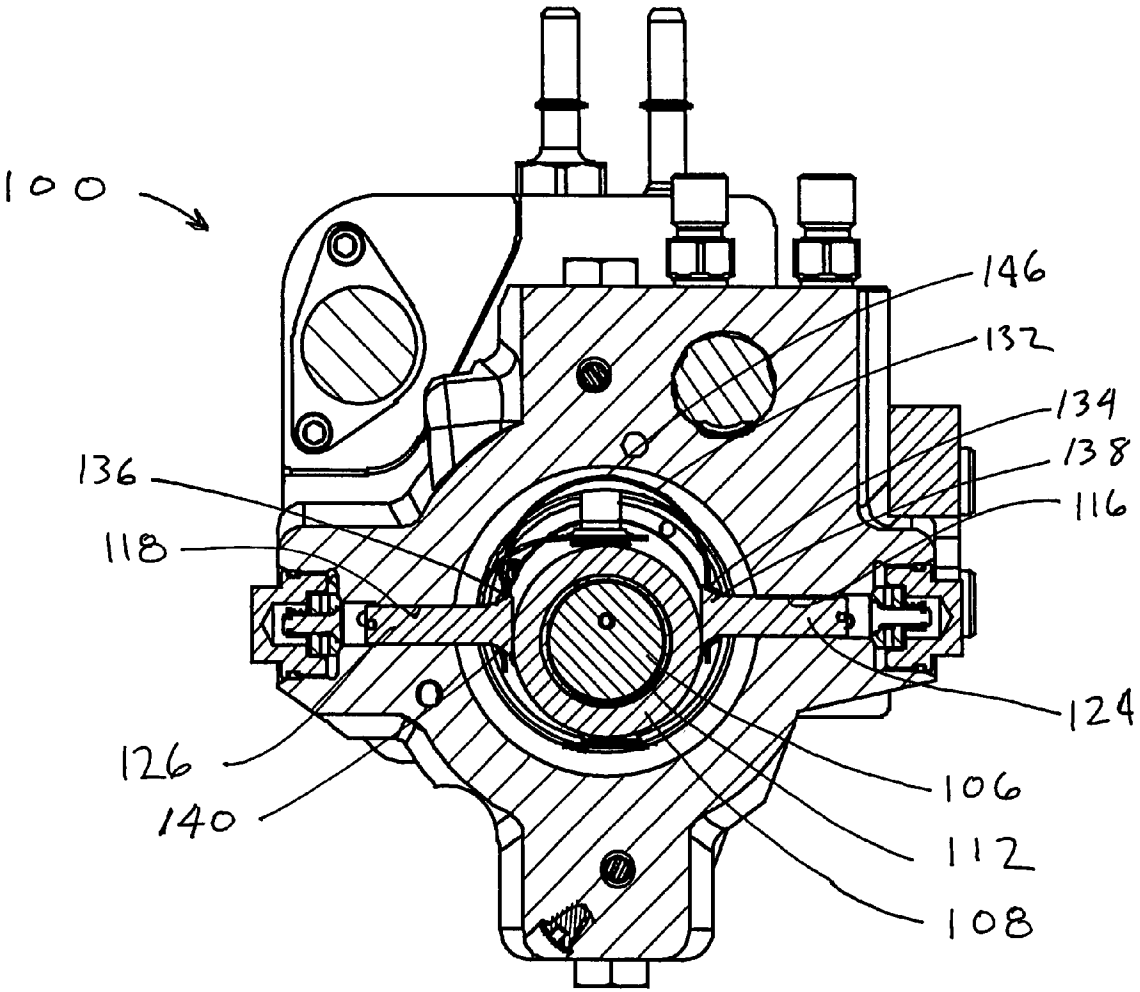
FIG. 10 is a cross section view, taken along line 10-10 of FIG. 9.

With particular reference to FIGS. 9 and 10, a four piston pump 100 has a cavity 102 through which a drive shaft 104 passes, and in particular, a unitary, eccentric drive member portion 106 rotates in the cavity in a manner described in the previous embodiments. The drive member could have two distinct portions. A pair of axially side by side, substantially cylindrical piston actuation rings 108, 110 are annularly mounted around the drive member. Bearing means 112, 114 are situated between the drive member and the actuation rings, for free rotation of the rings about the drive member. Two piston bores 116, 118, and 120, 122, are associated with each actuation ring, extending through the housing to the cavity in substantial opposition to each other. Each set or pair of opposed pistons can be offset from the drive axis as viewed along the drive axis, as illustrated at (x) in FIG. 2. A piston 124, 126, 128, 130 is situated respectively in each piston bore for reciprocation therein.

Each pair of opposed bores is connected by a substantially C-shaped band 132 situated in the cavity around one side of each actuation ring, having opposite ends 134, 136 which respectively engaged enlarged, preferably flared ends 138, 140 of the pistons. The C-band maintains a substantially constant distance between the actuation surfaces of the pistons, which ride on the rings. The band preferably rides in a guide channel 142 in the cavity wall, with the channel side walls 144 restricting displacement of the band in a direction along the pump axis, while permitting sliding displacement in the direction of piston reciprocation. The band is shown in FIG. 10 with the maximum bend point 146 substantially centered between the pistons.

Figure 11:
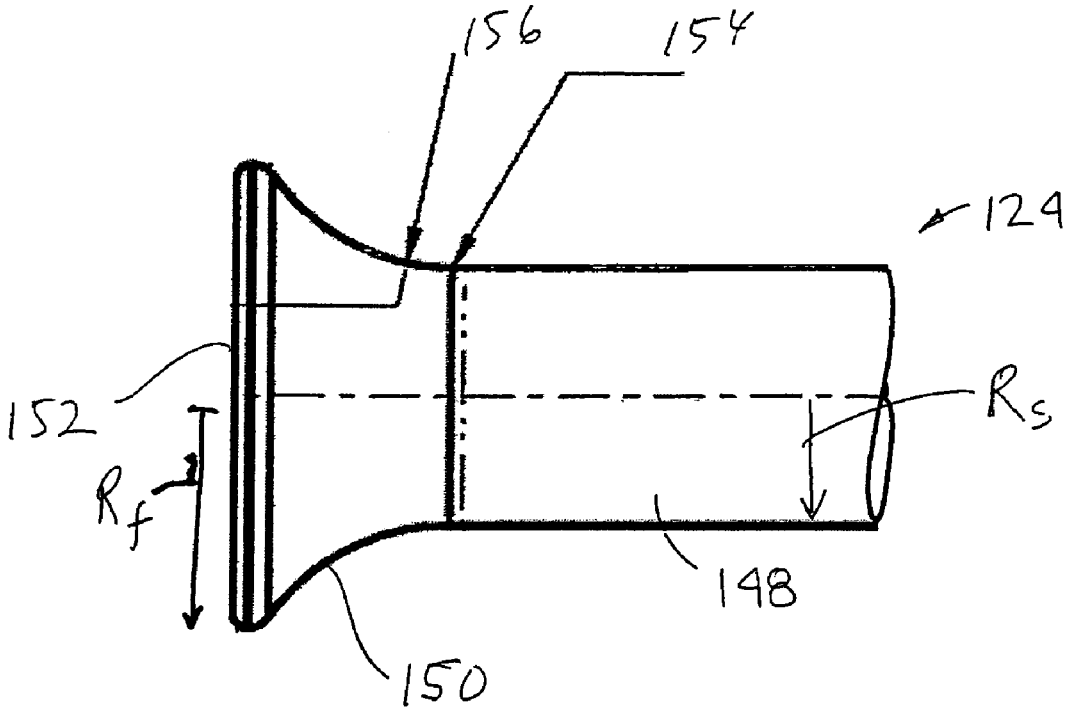
FIG. 11 shows the lower stem portion and associated shoe or foot of the preferred piston having a flared transition.

FIG. 11 shows the preferred characteristics of the lower portion of piston 124, which is representative of the other pistons. The piston has a stem portion 148 of radius $R_S$, leading to an enlarged shoe or foot portion 150 terminating in a substantially flat actuation surface having a radius $R_F$. The transition 154 from the stem to the foot portion is preferably blended to be smooth and continuous, without any step change in radius. The contouring as indicated at 156 preferably has a continuous curvature from the stem to the circumferential edge of the actuated end 152 of foot 150. In any event, the transition at 154 should not be abrupt, and if not smoothly blended, should form an angle of at least 135 degrees. In a typical embodiment, the radius $R_F$ is a least twice radius $R_S$, and the enlargement forms a transition shoulder 156 extending outwardly from the stem at an angle of at least 135 degrees for a radial distance of at least 1.5 times $R_S$. Thus, the less desirable, but nevertheless effective transition can extend angularly at least 135 degrees for 1.5 time $R_S$, before changing angle again to reach the flat surface of the actuated end 152.

Figure 12:
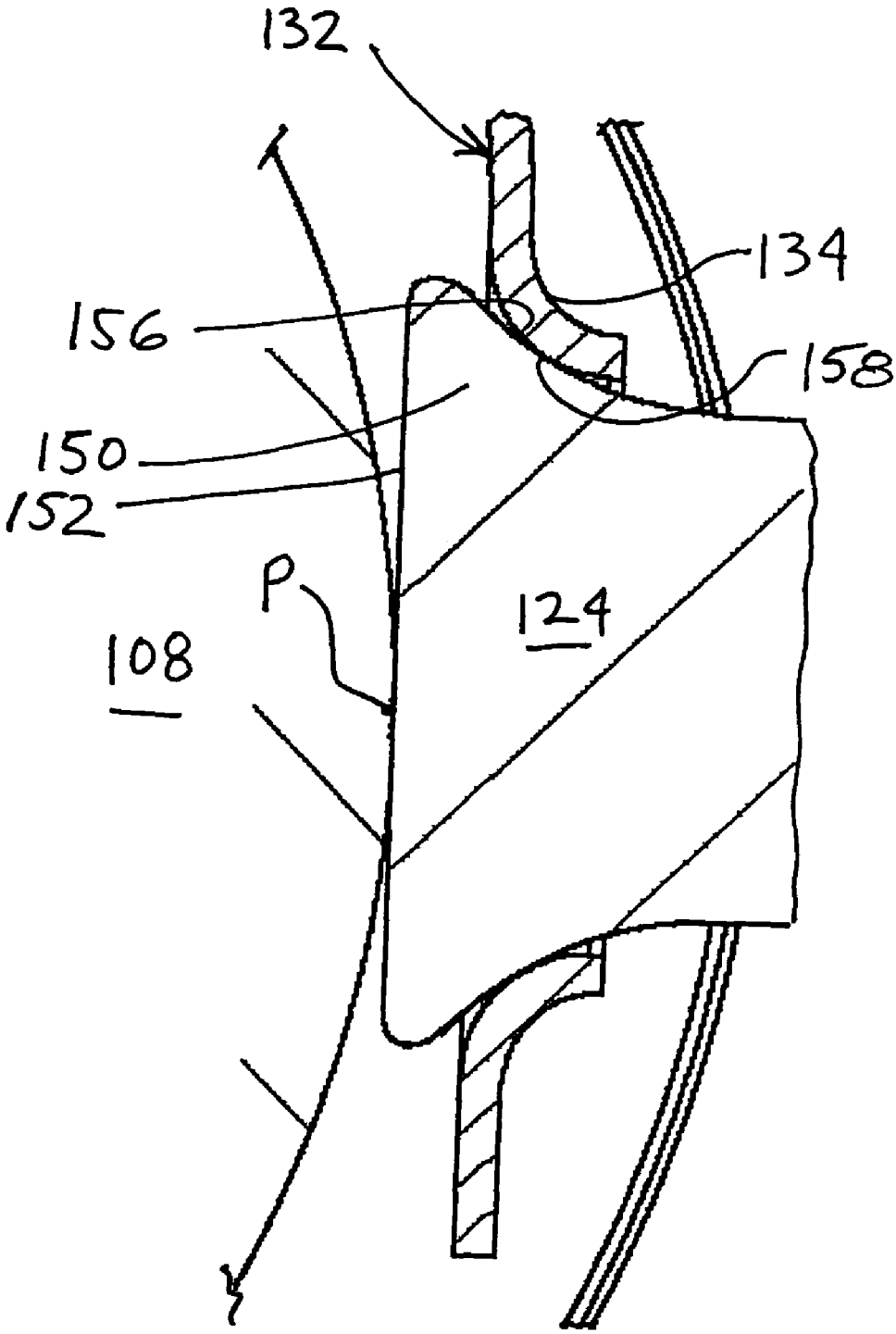
FIG. 12 is a large detailed view of the engagement of the C-band spring on the exterior of the foot portion of the piston shown in FIG. 11.

FIG. 12 shows the preferred engagement of the representative piston 124 with the spring band 132 and the roll ring 108. The band has a beveled aperture 158, which preferably is complementary over a significant extent, with the exterior contour surface 156 on the foot 150 of the piston.

FIG. 12 also shows that the contact line between the actuated surface 152 of the piston and the exterior surface of the roller 108, is not necessarily on the piston centerline. Rather, that contact point P will move toward and away from the circumference of the actuation surface 152 as the particular piston proceeds through its pumping cycle. And as will be discussed below, the effective or torque load imposed on the foot of the piston, from which stresses arise, is dependent on both the pressure between the roller 108 and the surface 152 at point P, and the location of the contact point P relative to the piston centerline. For example, a relatively small pressure exerted near the circumference of the actuation surface 152, can cause more stresses on the foot of the piston, than a high pressure near the piston centerline. With reference to FIG. 12, as point P moves downwardly, the portion of the foot 150 near point P would experience increased compressive stress, whereas the contoured surface as indicated at 156 in FIG. 12, would experience high tension stress. The absence of discontinuities in the foot portion of the piston avoids concentration of such stresses and prolongs piston life. This is coupled with the smooth engagement between surfaces 156 and 158, which thereby minimizes wear.

Figure 13:
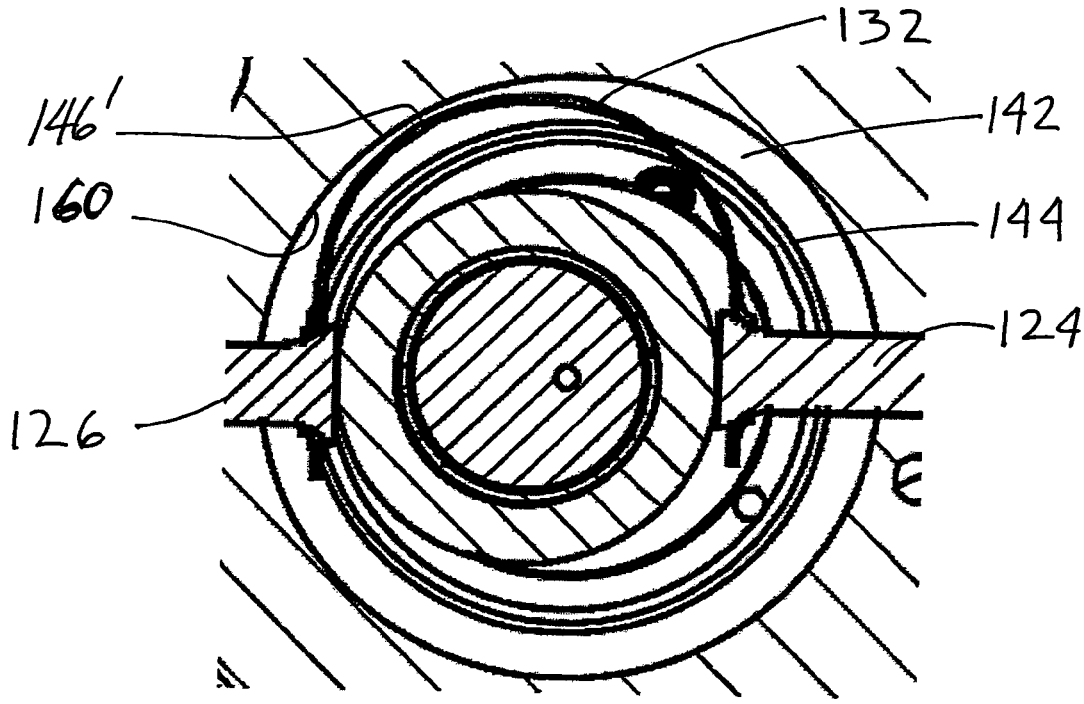
FIG. 13 is a detailed view of the cavity region of FIG. 10, in the condition where the left piston is at the top dead center position and the right piston is at the bottom dead center position.
Figure 14:
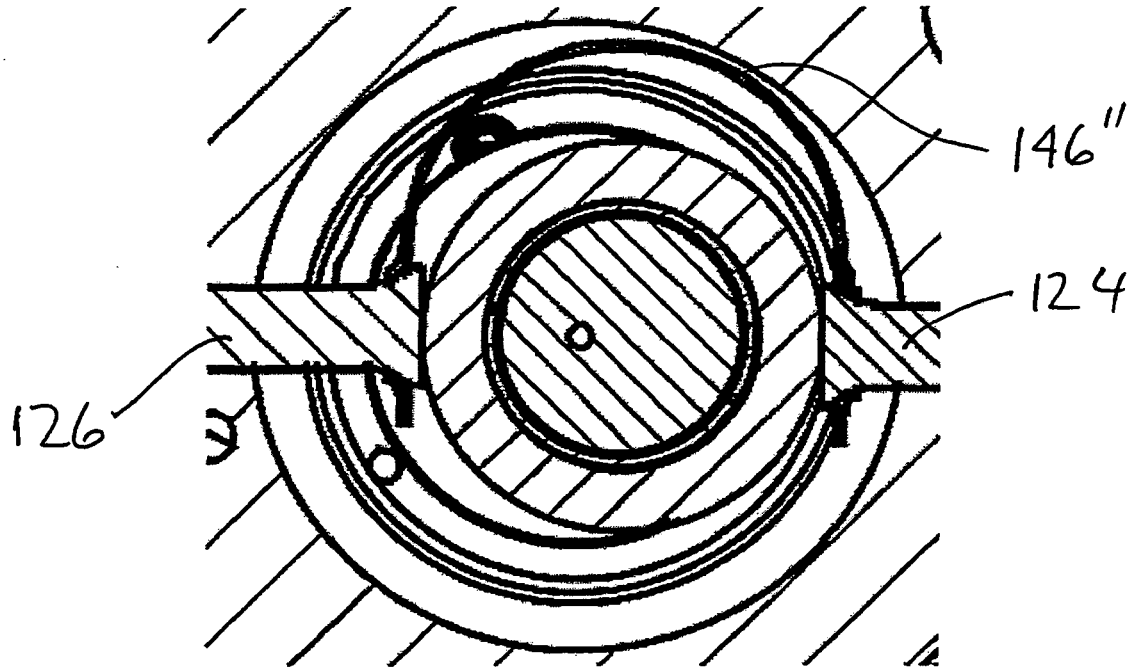
FIG. 14 is a view similar to FIG. 13, wherein the left piston is at the bottom dead center position and the right piston is at the top dead center position.

FIGS. 13 and 14 should be viewed in conjunction with FIG. 10, for a better understanding of the movement of the C-band 132 in channel 142. FIG. 13 shows the condition where piston 124 is at bottom dead center and piston 126 is at top dead center. Relative to the neutral condition in FIG. 10, the band 132 has shifted in the direction of piston 126, with the maximum curvature 146' shown well to the left of the cavity center. The location of maximum bend 146 contacts or is closely spaced, from the base 160 of the channel 142. During a subsequent portion of the pumping cycle, as shown in FIG. 14, with piston 124 at top dead center and piston 126 at bottom dead center the maximum bend 146" on the band is well to the right of the cavity centerline. The location of maximum bend 146', 146", changes according to the position of the eccentric and ring, but in all instances is within the channel. Furthermore, the channel has opposed lips or sidewalls 144 that also restrain the band from moving axially, throughout its displacement limits to the left and right as shown in FIGS. 13 and 14.

FIGS. 10, 13, and 14 show that the band spring as it moves with the pistons and roller from left to right, does not change shape or make contact with any part of the pump. The spring remains a statically preloaded part. Only when the preload is exceeded would the spring actually bend and allow the piston to lift off the roller. The spring is designed to have a preload in excess of the loads the pump will ever see at maximum operating conditions. A very stiff spring would allow unlimited pump speed, because it would maintain roller to plunger contact. During all positions of the spring, a portion of the spring is contained within the channel.

Figure 15A:
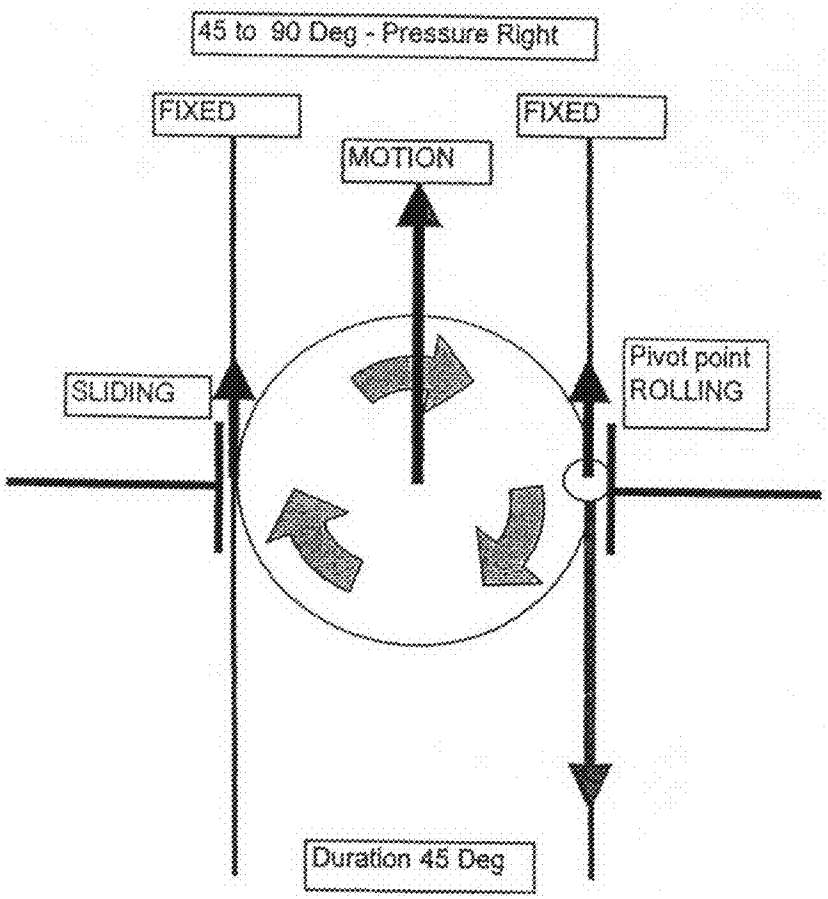
FIGS. 15A and B are schematic illustrations of the rolling and sliding relationship of the opposed pistons relative to the eccentric actuating roller, during portions of the pumping cycle.
Figure 15B:
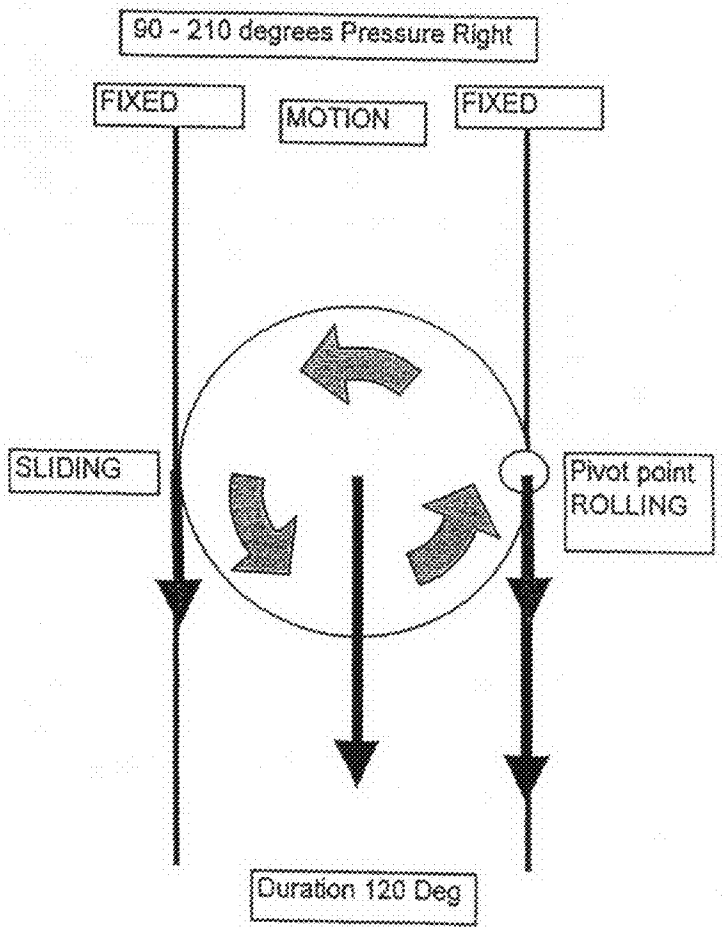
Figure 16:
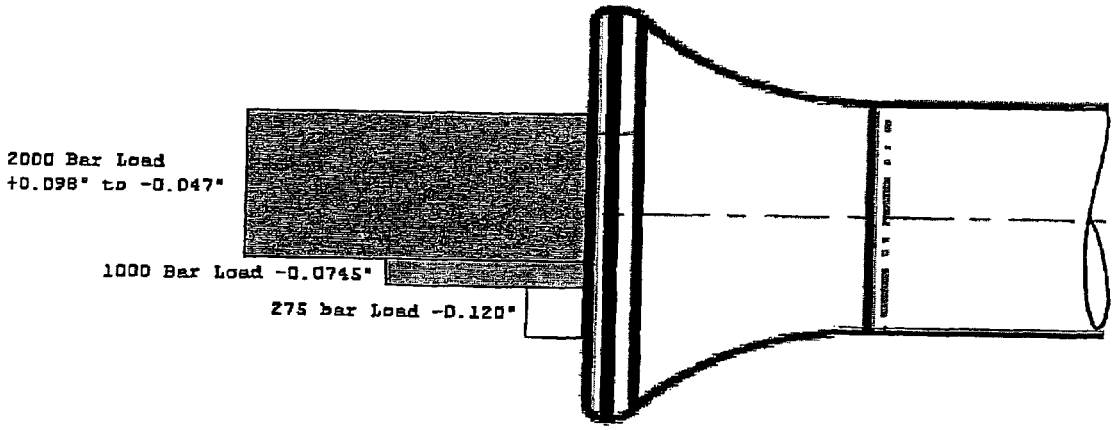
FIG. 16 is a schematic representation of the load distribution on the foot portion of the piston, after balancing in accordance with one aspect of the present invention.

The relationship of the roller, piston feet, and pivot point P during a portion of the cycle are shown in FIGS. 15A and B. Shaft rotation is clockwise as viewed from the non-driven end. The motion of the roller is dependent on the pressure in the pumping cavities. If there is a pressure on the right piston then the roller will roll along the right piston face and slide along the left piston face. If there is a pressure on the left piston then the roller will roll along the left piston face and slide along the right piston face. If the drive shaft eccentric is moving up or down it will change the direction that the roller is rolling. Preferably, the foot is coated with a low friction material, such as DLC (diamond like carbon), which is commercially available.

Conventional pistons have a foot that extends abruptly at a right angle to the stem, often in conjunction with an undercut. One of ordinary skill would offset the opposed pistons by (x)=½*E, where E is the eccentricity of the drive. This would split the load with half on the upper portion of the piston centerline, and half on the lower portion of the plunger centerline. As the driveshaft rotates through 180 degrees of pumping stroke, the contact point P starts at the lower portion of the piston face (−½*E) and sweeps upward to the upper portion of the piston face (+½*E) then sweeps back down to the lower position (−½*E) and the pressure drops off. This should theoretically torque load the plunger only from +½*E to −½*E. This simple approach does not consider the time/degrees of rotation required to reach zero pressure in the pumping chamber.

Test data showed that there was pressure within the pumping chamber for as late as 30 degrees of rotation. Plotting out the pressure vs location data caused 275 bar pressure to occur when the contact point was at 210 degrees of rotation and the contact point was −0.145" below the piston centerline. This torque load (i.e., pressure or force times distance) was very far out on the piston face and caused a high stress on the backside of the piston. This stress level was higher than with the 2000 bar load located closer to the centerline of the piston.

To define a new piston offset from the pump centerline, the load location and pressure data was balanced so that the torque load (load*distance) from the centerline was balanced above and below the piston centerline. This yielded a piston offset of nearly half that originally used. The load of 275 bar was moved from −0.145" to −0.120" and the 2000 bar load was actually raised up from +0.0729 to +0.098". This yielded a balance of stress and an increased safety factor for the piston.

It is believed that most opposed piston pumps will experience this 30 degree pressure decay. A general rule for the offset (x) used in designs without actual pressure vs degrees test data, should be ¼*E. This allows the piston diameter to eccentric ratio to be balanced in advance so that for pistons where $R_F \geqq 2.0 * R_S$ all piston loading occurs within the confines of the piston stem OD, and will not cause a bending moment and high tensile stress on the backside of the piston foot.

In general the given the stem nominal cross section as circular with a radius $R_S$ and the flat surface at the terminal end of the piston is circular with a radius $R_F$ that is at least about twice said radius $R_S$, the piston enlargement should form a transition shoulder extending outwardly from the stem at an angle of at least 135 degrees for a radial distance at least 1.5 times $R_S$. In many end uses, the ring bears on the terminal end of the piston between limits on either side of the piston centerline with a pressure of at least 200 bar for at least 200 degrees of drive shaft rotation during each pumping stroke, thereby imposing a torque load on the piston. In most such cases, the offset (x) is selected such that the torque load at one limit position is within 25% of the torque load at the other limit position.

The invention claimed is:

1. A high pressure radial piston fuel pump having an hydraulic head with two individual radial pumping pistons and associated pumping chambers, annularly spaced around a cavity in the head where a rotating eccentric drive member with associated actuation ring are situated, characterized in that a rolling interaction is provided between the actuation ring and the inner ends of the pistons for intermittent actuation, and relative rotation is provided between the actuation ring and the drive member each piston having a piston bore that has a centerline that intersects the actuation ring but is offset (X) from the drive axis as viewed in cross section perpendicularly to the drive axis, and the piston bore centerlines are parallel to each other but offset (Y) from each other as viewed in longitudinal section along the drive axis, wherein the hydraulic head defines the central cavity for receiving a rotatable drive shaft longitudinally disposed along a drive axis passing through the cavity;

the drive member is cylindrical and is rigidly carried by and offset from the drive shaft for eccentric rotation in the cavity about the drive axis as the drive shaft rotates;

the actuation ring is substantially cylindrical and is annularly mounted around the drive member;

bearing means are located between the drive member and the actuation ring, whereby the actuation ring is supported for freely rotating about the drive member;

each piston is situated respectively in a piston bore for free reciprocation therein, each said piston having an actuated end in the cavity and a pumping end remote from the cavity, wherein the pumping end cooperates with the piston bore to define a pumping chamber;

a piston shoe rigidly extends from the actuated end of each piston, and has an actuation surface for maintaining contact with the actuation ring during rotation of the drive shaft;

means are provided for biasing each piston toward the cavity;

a feed fuel valve train is provided for delivering charging fuel through an inlet passage in the head at a feed pressure to the pumping chamber;

a high pressure valve train is provided for delivering pumped fuel to a discharge passage in the head at a high pressure from the pumping chamber;

whereby during one complete rotation of the drive shaft, each pumping chamber undergoes a charging phase wherein the associated piston is retracted toward the cavity by the means for biasing, thereby increasing the volume of the pumping chamber to accommodate an inlet quantity of fuel from the inlet valve train, and a discharging phase wherein said associated piston is actuated away from the cavity by the actuation ring, thereby decreasing the volume of the pumping chamber and pressurizing the quantity of fuel for discharge through said discharge valve train.

2. The pump of claim 1, characterized in that a semi rigid yoke in the cavity connects the pistons and forces an inactive piston toward bottom dead center, while another piston is pumping.

3. The pump of claim 1, characterized in that the hydraulic head has a shaft mounting bore coaxial with the drive shaft axis, for receiving one end of the drive shaft, and bearing means for rotationally supporting said one end of the drive shaft; and a removable mounting plate is attached to the hydraulic head, said mounting plate having a shaft mounting throughbore for receiving the other end of the drive shaft while exposing said other end for engagement with a source of rotational power, bearing means for rotationally supporting said other end of the drive shaft.

4. The pump of claim 1, characterized in that said actuation ring has an outer surface that is barrel shaped, having a crown that rises and falls in the direction of the drive shaft axis.

5. The pump of claim 4, characterized in that the center of the crown of the outer surface is in a plane defined by the centerlines of the pumping bores.

6. The pump of claim 4, characterized in that the center of the crown of the outer surface lies in a plane parallel to but offset (Z) from the pumping bore centerlines, as viewed in longitudinal section along the drive axis.

7. A high pressure radial piston fuel pump having an hydraulic head with two individual radial pumping pistons and associated pumping chambers, annularly spaced around a cavity in the head where a rotating eccentric drive member with associated actuation ring are situated, characterized in that a rolling interaction is provided between the actuation ring and the inner ends of the pistons for intermittent actuation, and relative rotation is provided between the actuation ring and the drive member each piston having a piston bore that has a centerline that intersects the actuation ring but is offset (X) from the drive axis as viewed in cross section perpendicularly to the drive axis, and the piston bore centerlines are parallel to each other but offset (Y) from each other as viewed in longitudinal section along the drive axis, wherein the hydraulic head defines a central cavity for receiving a rotatable drive shaft longitudinally disposed along a drive axis passing through the cavity;

the drive member is a cylinder rigidly carried by and offset from the drive shaft for eccentric rotation in the cavity about the drive axis as the drive shaft rotates;

the piston actuation ring is substantially cylindrical and is annularly mounted around the drive member;

bearing means are located between the drive member and the actuation ring, whereby the actuating ring is supported for freely rotating about the drive member;

at least two piston bores extend in the housing to the cavity, each piston bore having a centerline that intersects the actuation ring;

a piston is situated respectively in each piston bore for free reciprocation and rotation therein, said piston having an actuated end in the cavity and a pumping end remote from the cavity, wherein the pumping end cooperates with the piston bore to define a pumping chamber;

a piston shoe rigidly extends from the actuated end of each piston, and has an actuation surface for maintaining contact with the actuation ring during rotation of the drive shaft;

means are provided for biasing each piston toward the cavity;

a feed fuel valve train is provided for delivering charging fuel through an inlet passage in the head at a feed pressure to the pumping chamber;

a high pressure valve train is provided for delivering pumped fuel to a discharge passage in the head at a high pressure from the pumping chamber;

whereby during one complete rotation of the drive shaft, each pumping chamber undergoes a charging phase wherein the associated piston is retracted toward the cavity by the means for biasing, thereby increasing the volume of the pumping chamber to accommodate an inlet quantity of fuel from the inlet valve train, and a discharging phase wherein said associated piston is actuated away from the cavity by the actuation ring, thereby decreasing the volume of the pumping chamber and pressurizing the quantity of fuel for discharge through said discharge valve train, and said actuation ring has an outer surface that is barrel shaped, with a crown that rises and falls in the direction of the drive shaft axis.

8. The pump of claim 7, characterized in that the center of the crown of the outer surface is in a plane defined by the centerlines of the pumping bores.

9. The pump of claim 7, characterized in that the high point of the crown lies in a plane parallel to but offset from the pumping bore centerlines, as viewed perpendicularly to the drive axis at a longitudinal section perpendicularly to the drive axis.

* * * * *